US006491769B1

(12) United States Patent
Smith et al.

(10) Patent No.: US 6,491,769 B1
(45) Date of Patent: Dec. 10, 2002

(54) NI-CO-CR HIGH TEMPERATURE STRENGTH AND CORROSION RESISTANT ALLOY

(75) Inventors: Gaylord D. Smith, Huntington, WV (US); Brian A. Baker, Kitts Hill, OH (US)

(73) Assignee: Inco Alloys International, Inc., Huntington, WV (US)

( * ) Notice: Subject to any disclaimer, the term of this patent is extended or adjusted under 35 U.S.C. 154(b) by 0 days.

(21) Appl. No.: 09/914,504

(22) PCT Filed: Jan. 24, 2001

(86) PCT No.: PCT/US01/02247

§ 371 (c)(1),
(2), (4) Date: Aug. 29, 2001

(87) PCT Pub. No.: WO01/53548

PCT Pub. Date: Jul. 26, 2001

Related U.S. Application Data

(60) Provisional application No. 60/177,862, filed on Jan. 24, 2000.

(51) Int. Cl.[7] ..... C22C 19/03

(52) U.S. Cl. ..... 148/428; 420/443; 420/448; 420/449

(58) Field of Search ..... 148/428; 420/443, 420/447, 448, 449

(56) References Cited

U.S. PATENT DOCUMENTS 4,110,110 A 8/1978 Kondo et al.
4,379,120 A 4/1983 Whitney et al.
4,631,169 A 12/1986 Isobe et al.
4,844,864 A 7/1989 Frank
4,871,512 A 10/1989 Takagi et al.
5,017,249 A 5/1991 Smith et al.
6,258,317 B1 * 7/2001 Smith et al. ..... 420/448
6,287,398 B1 * 9/2001 Smith et al. ..... 148/428

FOREIGN PATENT DOCUMENTS

JP 60-70155 A 4/1985

* cited by examiner

*Primary Examiner*—Roy King
*Assistant Examiner*—Harry D Wilkins, III
(74) *Attorney, Agent, or Firm*—Robert F. Dropkin, Esq.; Webb Ziesenheim Logsdon Orkin & Hanson, P.C.

(57) ABSTRACT

A high strength, corrosion resistant Cr—Co—Ni base alloy for long-life service at 530° C. to 820° C. containing in % by weight about 23.5–25.5% Cr, 15.0–22.0% Co, 0.2–2.0% Al, 0.5–2.5% Ti, 0.5–2.5% Nb, up to 2.0% Mo, up to 1.0% Mn, 0.3–1.0% Si, up to 3.0% Fe, up to 0.3% Ta, up to 0.3% W, 0.005–0.08% C, 0.01–0.3 % Zr, 0.001–0.01% B, up to 0.05% rare earth as misch metal, 0.005–0.025% Mg plus optional Ca, balance Ni including trace additions and impurities. The alloy provides a combination of strength, ductility, stability, toughness and oxidation/sulfidation resistance so as to render the alloy range uniquely suitable for engineering applications where oxygen/sulfur-containing atmospheres are life limiting, in applications such as exhaust valves for diesel engines and in tubes for coal-fired steam boilers.

5 Claims, No Drawings

NI-CO-CR HIGH TEMPERATURE STRENGTH AND CORROSION RESISTANT ALLOY

This application claims benefit of Provisional Application Serial No. 60/177,862 filed Jan. 24, 2000.

BACKGROUND OF THE INVENTION

1. Field of the Invention

The present invention relates generally to Ni—Co—Cr base alloys and, more particularly, to a high strength, sulfidation resistant Ni—Co—Cr alloy for long-life service at 538° C. to 816° C. The alloy of the present invention provides a combination of strength, ductility, stability, toughness and oxidation/sulfidation resistance so as to render the alloy range uniquely suitable for engineering applications where sulfur-containing atmospheres are life limiting.

2. Discussion of the Related Art

Over the years, researchers have continually developed alloys meeting requirements for both high strength at intermediate temperatures and corrosion resistance under severe environmental conditions. This quest for increasing performance is far from over as designers and engineers continuously seek to increase productivity, lower operating costs, improve yields and extend service lives. All too often, however, researchers terminated their efforts when the target combination of properties was achieved. Such is the case, for example, in two industrial areas in critical need of advanced alloys to maintain progress. These industrial applications are diesel exhaust valves and alloys for coal-fired boilers. These applications have in common that their developers require ever-increasing strength at increasingly higher temperatures, improved resistance to sulfur-containing atmospheres as atmospheres become more demanding and increases in service lives to assure trouble-free operation over the life of the equipment. Heavy-duty diesel engines in off-road construction equipment, often operating in remote corners of the globe where refined, low sulfur fuels are not available, are suffering exhaust valve failure due to sulfidation attack. Maintenance of these engines, usually requiring original equipment mechanics, can become prohibitively expensive and time-consuming. These same engines are now being designed for higher temperatures to increase power and efficiency. This has only served to exacerbate the alloy challenge.

Ultra supercritical boiler designers are creating a similar problem in coal-fired boilers as utilities seek to improve efficiency by raising steam pressure and temperature. Today's boilers with efficiencies around 45% typically operate at a 290 bar steam pressure and 580° C. steam temperature. Boiler designers are setting their sights on 50% efficiency or better by raising the steam conditions as high as 375 bar/700° C. To meet this requirement in the boiler tubing, the 100,000 hour stress rupture life must exceed 100 MPa at 750° C. (mid radius tube wall temperature needed to maintain a 700° C. steam temperature at the inner wall surface). Raising steam temperature has made coal ash corrosion more troublesome, placing a further requirement on any new alloy. This corrosion requirement is less than 2 mm of metal loss in 200,000 hours for exposures in the temperature range of 700° C. to 800° C. For economy, the boiler tube must be as thin-walled as possible (i.e., <8 mm wall thickness) and be fabricable into long lengths in high yield on conventional tube making equipment. This places a major constraint on the maximum work-hardening rate and yield strength tolerable in manufacture and field installation, physical property characteristics running counter to the need for superior strength in valve and boiler tube service.

To meet the new strength and temperature requirements of an advanced diesel exhaust valve or a future boiler tube alloy, designers must exclude the usual ferritic, solid solution austenitic and age-hardenable alloys heretofore employed for this service. These materials commonly lack one or more of the requirements of adequate strength, temperature capability and stability or sulfidation resistance. For example, the typical age-hardenable alloy, in order to develop high strength at intermediate temperatures, must be alloyed with insufficient chromium for peak sulfidation resistance in order to maximize the age-hardening potential of the alloy. Adding chromium not only degrades the strengthening mechanism but, if added in excess, can result in embrittling sigma, mu or alpha-chromium formation. Since 538° C. to 816° C. is a very active range for carbide precipitation and embrittling grain boundary film formation, alloy stability is compromised in many alloys in the interest of achieving high temperature strength and adequate sulfidation resistance.

The present invention overcomes the problems of the prior art by providing a Ni—Co—Cr-base alloy range possessing exceptional resistance to sulfur-containing atmospheres containing limiting amounts of Al, Ti, Nb, Mo and C for high strength at 538° C. to 816° C. while retaining ductility, stability and toughness.

The present invention contemplates a newly-discovered alloy range that extends service conditions for the above-described critical industrial applications notwithstanding the seemingly incongruous constraints imposed by the alloying elements economically available to the alloy developer. Past alloy developers commonly claimed broad ranges of their alloying elements which, when combined in all purported proportions, would have faced these counter influences on overall properties. The present inventors have discovered that a narrow range of composition does exist that allows one to fabricate a high strength alloy for service at 538° C. to 816° C. with both sulfidation resistance, phase stability and workability. A better appreciation of the alloying difficulties can be presented by defining below the benefits and impediments associated with each element employed in the present invention.

SUMMARY OF THE INVENTION

A high strength, sulfidation resistant Cr—Co—Ni base alloy for long-life service at 538° C. to 816° C. containing, in % by weight, about 23.5–25.5%Cr, 15.0–22.0%Co, 0.2–2.0%Al, 0.5–2.5%Ti, 0.5–2.5%Nb, up to 2.0%Mo, up to 1.0%Mn, 0.3–1.0%Si, up to 3.0%Fe, up to 0.3%Ta, up to 0.3%W, 0.005–0.08%C. 0.01–0.3%Zr, 0.001–0.01%B, up to 0.05% rare earth as misch metal, 0.005–0.025%Mg plus optional Ca, balance Ni, including trace additions, such as up to 0.05%La, up to 0.05%Y, plus impurities. The alloy provides a combination of strength, ductility, stability, toughness and oxidation/sulfidation resistance so as to render the alloy range uniquely suitable for engineering applications where sulfur-containing atmospheres are life limiting.

DESCRIPTION OF THE PREFERRED EMBODIMENT

The combination of elements set forth above unexpectedly and surprisingly possesses all of the critical attributes required of high strength applications in sulfur-containing atmospheres. It has been discovered that sulfidation resistance can be achieved by alloying within a narrow range of Cr (23.5–25.5%Cr) without destroying phase stability resulting from embrittling phases by concurrently limiting certain elements to very narrow ranges, namely, Mo to less than 2%, C to less than 0.08%, Fe to less than 3.0% and the total Ta plus W content to less than 0.6%. Less than 23.5%Cr results in inadequate sulfidation resistance and greater than 25.5%Cr produces embrittling phases even with the alloy restrictions defined above. It should be mentioned that, unless otherwise specified, all percentages of the various alloy constituents set forth herein are percent by weight.

Oftentimes, in striving for maximum corrosion resistance, the resultant alloys lack the required high temperature strength. This has been solved by the instant invention by balancing the weight percent of precipitation hardening elements to a narrow range where the resulting volume percent of hardening phase is between about 10 and 20% within the Ni—Co—Cr matrix. Excessive amounts of the hardener elements not only reduce phase stability and lower ductility and toughness, but also render valve and tubing manufacturability extremely difficult, if not impossible. The selection of each elemental alloying range can be rationalized in terms of the function each element is expected to perform within the compositional range of the present invention. This rationale is defined below.

Chromium (Cr) is an essential element in the alloy of the invention because Cr assures development of a protective scale which confers the high temperature oxidation and sulfidation resistance vital for the intended applications. In conjunction with the minor elements Zr (up to 0.3%), Mg (up to 0.025%) and Si (up to 1.0%), the protective nature of the scale is even more enhanced and made effective to higher temperatures. The function of these minor elements is to enhance scale adhesion, scale density and resistance of the scale to decomposition. The minimum level of Cr is chosen to assure α-chromia scale formation at 538° C. and above. This level of Cr was found to be about 23.5%. Slightly higher Cr levels accelerated α-chromia formation but did not change the nature of the scale. The maximum Cr level for this alloy range was determined by alloy stability and workability. This maximum level of Cr was found to be about 25.5%.

Cobalt (Co) is an essential matrix-forming element because Co contributes to hot hardness and strength retention at the upper regions of the intended service temperature (538° C.–816° C.) and contributes in a significant way to the high temperature corrosion resistance of the alloy range. However, because of cost, it is preferred to maintain the level of Co below 40% of that of the Ni content. Thus the beneficial range of the Co content becomes 15.0–22.0%.

Aluminum (Al) is an essential element in the alloy of the present invention not only because Al contributes to deoxidation but because it reacts with nickel (Ni) in conjunction with Ti and Nb to form the high temperature phases, gamma prime ($Ni_3Al$,Ti,Nb) and eta phase ($Ni_3Ti$,Al,Nb). The Al content is restricted to the range of 0.2–2.0%. The minimum total of elements contributing the hardening elements are related by the following formula:

$$\%Al+0.56\times x\%Ti+0.29\times\%Nb=1.7\%,\ \text{preferably} \geqq 2.0\% \quad (1)$$

While the maximum hardening elements are related by the following formula:

$$\%Al+0.56\times\%Ti+0.29\times\%Nb=3.8\%,\ \text{preferably} <3.5\% \quad (2)$$

Larger amounts than 2.0%Al in conjunction with the other hardener elements markedly reduce ductility, stability and toughness and reduce workability of the alloy range. Internal oxidation and sulfidation can increase with higher amounts of Al.

Titanium (Ti) in the range 0.5–2.5% is an essential strengthening element as defined in equations (1) and (2), above. Ti also serves to act as grain size stabilizer in conjunction with Nb by forming a small amount of primary carbide of the (Ti,Nb)C type. The amount of carbide is limited to less than 1.0 volume % in order to preserve hot and cold workability of the alloy. Ti in amounts in excess of 2.5% is prone in internal oxidation to leading to reduced matrix ductility.

Niobium (Nb) in the range 0.5–2.5% is also an essential strengthening and grain size control element in the alloy of the present invention. The Nb content must fit within the constraints of equations (1) and (2), above, when Al and Ti are present. Nb along with Ti can react with C to form primary carbides which act as grain size stabilizers during hot working. Compositions 2 through 4 of Table IIB contain increasing amounts of Nb which, when one examines the flue gas/coal ash corrosion data of Table VI, finds that Nb has a negligible effect on the rate of corrosion within the limits of the present invention. Table VI presents metal loss and depth of attack for 2,000 hours at 700° C. in a flue gas environment of 15%$CO_2$B4%$O_2$B 1.0%$SO_2$Bbal.$N_2$ flowing at the rate of 250 cubic centimeters per minute. The specimens were coated with a synthetic ash comprising 2.5%$Na_2SO_4$+2.5%$K_2SO_4$+31.67%$Fe_2O_3$+31.67%$SiO_2$31.67%$Al_2O_3$. An excessive amount of Nb can reduce the protective nature of protective scale and, hence, is to be avoided. Tantalum and W also form primary carbides which can function similarly to that of Nb and Ti. However, their negative effect on α-chromia stability limits their presence of each to less than 0.3%.

Molybdenum (Mo) can contribute to solid solution strengthening of the matrix but must be restricted to less than 2.0% due to its apparent deleterious effect on oxidation and sulfidation resistance when added in greater amounts to the alloys of the present invention. Table V shows the reduction in sulfidation resistance as a function of Mo content based on metal loss and depth of attack after times to 3,988 hours at 700° C. in a flue gas environment of 15%$CO_2$B4%$O_2$B 1.0%$SO_2$Bbal.$N_2$ flowing at the rate of 250 cubic centimeters per minute. The specimens were coated with a synthetic ash comprising 2.5%$Na_2SO_4$ +2.5%$K_2SO_4$+31.67%$Fe_2O_3$+31.67%$SiO_2$+31.67%$Al_2O_3$.

Manganese (Mn), while an effective desulfurizer during melting, is overall a detrimental element in that it reduces protective scale integrity. Consequently, the Mn content is maintained below 0.5%. Mn, above this level, degrades the α-chromia phase by diffusing into the scale and forming a spinel, $MnCr_2O_4$. This oxide is significantly less protective of the matrix than is α-chromia.

Silicon (Si) is an essential element in the alloy according to the present invention because Si ultimately forms an enhancing silica ($SiO_2$) layer beneath the α-chromia scale to further improve corrosion resistance in oxidizing and sulfidizing environments. This is achieved by the blocking action that the silica layer contributes to inhibiting ingress of the molecules or ions of the atmosphere and the egress of cations of the alloy. Levels of Si between 0.3 and 1.0% are effective in this role. Excessive amounts of Si can contribute to loss of ductility, toughness and workability.

Iron (Fe) additions to the alloys of the invention lower the high temperature corrosion resistance by reducing the integrity of the α-chromia scale by forming the spinel, $FeCr_2O_4$. Consequently, it is preferred that the level of Fe be maintained at less than 3.0%.

Zirconium (Zr) in amounts between 0.01–0.3% and boron (B) in amounts between 0.001–0.01% are effective in contributing to high temperature strength and Stress rupture ductility. Larger amounts of these elements lead to grain boundary liquation and markedly reduced hot workability. Zr in the above compositional range also aids scale adhesion under thermally cyclic conditions. Magnesium (Mg) and optionally calcium (Ca) in a total amount between 0.005 and 0.025% are both an effective desulfurizer of the alloy and a contributor to scale adhesion. Excessive amounts of these elements reduce hot workability and lower product yield. Trace amounts of La, Y, or misch metal may be present in the alloys of the invention as impurities or as deliberate additions up to 0.05% to promote hot workability and scale adhesion. However, their presence is not mandatory as is that of Mg and optionally Ca.

Carbon (C) should be maintained between 0.005–0.08% to aid grain size control in conjunction with Ti and Nb since the carbides of these elements are stable in the hot working range (1000–1175° C.) of the alloys of the present invention. These carbides also contribute to strengthening the grain boundaries to enhance stress rupture properties.

Nickel (Ni) forms the critical matrix and must be present in an amount greater than 45% in order to assure phase stability, adequate high temperature strength, ductility, toughness and good workability.

EXAMPLES

Examples of compositions within the alloy range of the present invention are presented in Table I and current commercial and experimental alloys which are outside the scope of the invention and use or considered for use in boiler designs and advanced engines are listed in Tables IIA and IIB.

Alloy Preparation and Mechanical Testing

Alloys A through I in Table I and alloys 1 through 6 (except alloy 5) of Table IIA were vacuum induction melted as 25 kg ingots, although alloy C was cast as a 150 kg ingot which was then vacuum arc remelted into two 75 kg ingots 150 mm in diameter by length. The ingots were homogenized at 1204° C. for 16 hours and subsequently hot worked to 15 mm bar at 1177° C. with reheats as required to maintain the bar temperature at least at 1050° C. The final anneal was for times up to two hours at 1150° C. and water quenched. Standard tensile and stress rupture specimens were machined from both annealed and annealed plus aged bar (aged at 800° C. for 8 hours and air cooled). Annealed and aged room temperature tensile strength plus high temperature tensile properties are presented in Table III for alloy C. Annealed and annealed plus aged room temperature tensile data for alloys B and D are presented in Table IIIA. Table IV lists typical stress rupture test results for the alloys B, C and D.

Characterization of High Temperature Corrosion Resistance

Pins for corrosion testing were machined to approximately 9.5 mm diameter by 19.1 mm length. Each pin was given a 120 grit finish and, if tested in the flue gas/coal ash environment, coated with coal ash comprising 2.5%$Na_2SO_4$+2.5% $K_2SO_4$+31.67%$Fe_2O_3$+31.67%$SiO_2$+31.67%$Al_2O_3$ using a water slurry. The weight of the coal ash coating was approximately 15 mg/cm$^2$. The flue gas environment was composed of 15%$CO_2$B4%$O_2$B1.0%$SO_2$Bbal. $N_2$ flowing at the rate of 250 cubic centimeters per minute. The testing was conducted for times ranging from 1,000 to 3,988 hours after which the specimens were metallographically sectioned and the rate of metal loss and depth of attack by oxidation and/or sulfidation determined. Specimens that exhibited a rate of metal loss or depth of less than 0.02 mm in 2,000 hours would have a corrosion loss of less than 2 mm in 200,000 hours. Table V presents these results for selected compositions of Tables I and II. Alloys within the scope of the invention meet the corrosion resistance requirement whereas alloys even slightly outside the compositional range of the invention fail to meet the requirement.

Hot corrosion of diesel exhaust valves occurs when deposits accumulate on the valve head and are subjected to engine exhausts at temperatures in excess of about 650° C. This corrosive deposit can be simulated by a mixture of about 55%$Ca_2SO_4$+30%$Ba_2SO_4$+10%$Na_2SO_4$+5%C. The mixture along with a test pin, described above, was placed in a MgO crucible and exposed to a temperature of 870° C. for 80 hours. Following testing, the pins were metallographically examined and the depth of corrosion penetration was determined. Table VII records the comparison of alloy C with the currently employed diesel exhaust valve alloys. It is clear that alloy C improves corrosion resistance by 250% over that of the more commonly used diesel exhaust valve alloys in service today.

TABLE I

Compositions of the Alloys of The Present Invention (Weight Percent)

| Heat | Ni | Co | Cr | Al | Ti | Nb | Mo | Si | Fe | Mn | Ca | Mg | Zr | B | C |
|---|---|---|---|---|---|---|---|---|---|---|---|---|---|---|---|
| A | 49.73 | 19.74 | 23.88 | 1.51 | 2.47 | <0.01 | 0.12 | 0.57 | 1.59 | 0.20 | 0.0001 | 0.0085 | — | 0.0029 | 0.14 |
| B | 48.64 | 19.75 | 24.05 | 0.84 | 2.00 | 2.04 | 0.54 | 0.51 | 1.14 | 0.31 | 0.0025 | 0.0066 | 0.05 | 0.0052 | 0.07 |
| C | 48.46 | 19.80 | 24.97 | 0.87 | 1.69 | 2.01 | 0.58 | 0.47 | 0.71 | 0.30 | — | 0.0060 | 0.04 | 0.0012 | 0.06 |
| D | 48.38 | 19.88 | 25.91 | 0.94 | 1.38 | 0.75 | 0.55 | 0.54 | 1.14 | 0.38 | 0.0025 | 0.0068 | 0.06 | 0.0068 | 0.03 |
| E | 47.27 | 19.91 | 25.26 | 0.84 | 1.93 | 2.01 | 0.59 | 0.51 | 1.13 | 0.30 | 0.0016 | 0.0072 | 0.02 | 0.0057 | 0.10 |
| F | 47.65 | 19.84 | 25.00 | 0.82 | 1.95 | 2.05 | 0.53 | 0.52 | 1.14 | 0.28 | 0.0069 | 0.0091 | 0.01 | 0.0021 | 0.07 |
| G | 48.42 | 19.84 | 24.98 | 1.01 | 1.48 | 1.04 | 1.04 | 0.64 | 1.14 | 0.38 | 0.0016 | 0.0070 | 0.06 | 0.0040 | 0.06 |
| H | 46.60 | 19.80 | 24.99 | 0.82 | 2.03 | 2.02 | 1.51* | 0.46 | 1.15 | 0.29 | 0.0013 | 0.0059 | 0.05 | 0.0061 | 0.03 |
| I | 47.72 | 19.99 | 24.14 | 1.45 | 2.99 | 0.97 | 1.53 | 0.85 | 0.06 | 0.20 | <0.01 | 0.0070 | — | 0.003 | 0.05 |

*Alloy H also contains 0.17% Ta as carbide formers

TABLE IIA

Compositions of Alloys Outside The Range of The Present Invention Used in Flue Gas/Coal Ash Corrosion Testing (Weight Percent)

| Heat | Ni | Co | Cr | Al | Ti | Nb | Mo | Si | Fe | Mn | Ca | Mg | Zr | B | C |
|---|---|---|---|---|---|---|---|---|---|---|---|---|---|---|---|
| 1 | 49.92 | 19.87 | 22.96 | 0.73 | 1.38 | 0.52 | 3.08 | 0.31 | 0.77 | 0.30 | 0.013 | 0.0061 | 0.06 | 0.0045 | 0.03 |
| 2 | 48.30 | 19.94 | 24.02 | 1.43 | 0.52 | 1.32 | 3.09 | 0.33 | 0.60 | 0.31 | 0.009 | 0.0060 | 0.06 | 0.0043 | 0.03 |
| 3 | 47.75 | 19.93 | 24.02 | 1.78 | 0.57 | 1.42 | 3.09 | 0.34 | 0.61 | 0.31 | 0.010 | 0.0073 | 0.06 | 0.0045 | 0.03 |
| 4 | 47.76 | 19.90 | 24.01 | 1.41 | 0.71 | 1.71 | 3.08 | 0.33 | 0.61 | 0.31 | 0.010 | 0.0066 | 0.06 | 0.0043 | 0.03 |
| 5* | 49.7 | 20.0 | 20.0 | 1.2 | 2.1 | — | 5.8 | 0.4 m | 0.7 m | 0.6 m | — | — | — | 0.0050 | 0.06 |
| 6 | 43.95 | 19.79 | 24.14 | 0.63 | 2.01 | 2.03 | 5.9 | 0.32 | 0.63 | 0.29 | 0.004 | 0.0092 | 0.01 | 0.0016 | 0.11 |

*Alloy 5 is commercial alloy NIMONIC alloy 263

TABLE IIB

Compositions or Alloys Outside The Range of The Present Invention Used in Diesel Exhaust Valve Corrosion Testing (Weight Percent)

| Heat | Ni | Cr | Al | Ti | Nb | Mo | Si | Fe | Mn | C |
|---|---|---|---|---|---|---|---|---|---|---|
| INCONEL alloy 751 | 72.7 | 15.3 | 1.22 | 2.57 | 0.87 | — | 0.50 max | 6.64 | 0.16 | 0.08 |
| NIMONIC alloy 80A | 71.8 | 19.5 | 1.4 | 2.25 | — | — | 1.0 max | 3.0 max | 1.0 max | 0.10 max |
| Pyromet 31 | 56.5 | 22.6 | 1.25 | 2.25 | 0.85 | 2.00 | 0.2 max | 14.3 | 0.2 max | 0.04 |

TABLE III

Tensile Properties of Alloy C As-Annealed (1150° C./30 Minutes/Water Quenched) and As-Annealed plus Aged (800° C./16 Hours/Air Cooled)

| Temperature (° C.) | Yield Strength (MPa) | Ultimate Tensile Strength (MPa) | Elongation (%) | Reduction of Area (%) |
|---|---|---|---|---|
| As-Annealed (1150° C./30 Minutes/Water Quenched) | | | | |
| 74 | 314 | 796 | 57.5 | 67.5 |
| As-Annealed Plus Aged (800° C./16 Hours/Air Cooled) | | | | |
| 74 | 721 | 1169 | 31.4 | 49.4 |
| 538 | 616 | 980 | 31.3 | 39.0 |
| 593 | 607 | 992 | 31.4 | 32.8 |
| 649 | 621 | 1023 | 38.4 | 39.8 |
| 704 | 648 | 914 | 37.9 | 43.7 |
| 760 | 608 | 766 | 32.5 | 43.9 |
| 800 | 556 | 652 | 34.8 | 46.2 |
| 816 | 514 | 608 | 37.7 | 47.8 |
| 871 | 304 | 365 | 55.2 | 67.8 |
| 927 | 148 | 200 | 63.5 | 79.4 |
| 982 | 60 | 105 | 112.5 | 93.1 |

TABLE IIIA

Room Temperature Tensile Properties of Alloys B and D As-Annealed (1150° C./30 Minutes/Water Quenched) and As-Annealed plus Aged (800° C./16 Hours/Air Cooled)

| Alloy | Heat Treatment | Yield Strength (MPa) | Ultimate Tensile Strength (MPa) | Elongation (%) | Reduction Of Area (%) |
|---|---|---|---|---|---|
| Alloy B | Annealed | 530 | 1002 | 43.4 | 47.4 |
| Alloy B | Aged | 724 | 1104 | 27.1 | 32.5 |
| Alloy D | Annealed | 305 | 820 | 51.8 | 57.8 |
| Alloy D | Aged | 588 | 1053 | 34.1 | 42.3 |

TABLE IV

Stress Rupture Test Results for Alloys B, C and D. All Specimens Were Annealed at 1150° C./2 Hours/Water Quenched Plus Aged at 800° C./16 Hours/Air Cooled

| Alloy | Temperature (° C.) | Stress on Specimen (MPa) | Rupture Life (Hours) | Elongation (%) |
|---|---|---|---|---|
| Alloy B | 816 | 207 | 227 | 13.6 |
| | 900 | 100 | 71.2 | 53.8 |
| Alloy C | 700 | 455 | 256 | 21.2 |
| | | | 457 | 18.0 |
| | | | 575 | 19.3 |
| | 850 | 100 | 470+ | — |
| Alloy D | 700 | 400 | 253 | 11.5 |
| | 750 | 250 | 396 | 12.2 |
| | | 350 | 153 | 12.6 |
| | | 100 | 678 | 45.0 |
| | 840 | 100 | 412 | 39.2 |
| | 850 | | | |

TABLE V

Flue Gas/Coal Ash Corrosion Data for Selected Alloys Within and Without the Compositional Range of The Present Invention. The Flue Gas Mixture Was 15% $CO_2$B 4% $O_2$B 1.0% $SO_2$Bbal. $N_2$ Flowing at The Rate of 250 Cubic Centimeters per Minute. The Coal Ash Was Composed of 2.5% $Na_2SO_4$ + 2.5% $K_2SO_4$ + 31.67% $Fe_2O_3$ + 31.67% $SiO_2$ + 31.67% $Al_2O_3$ and Applied Using a Water Slurry. The Weight of The Coal Ash Coating Was Approximately 15 mg/cm$^2$. Average uniform metal loss and depth of attack was determined metallographically.

| Alloy | Temperature (° C.) | Time (Hours) | Metal Loss (mm) | Depth of Attack (mm) |
|---|---|---|---|---|
| Alloy A | 775 | 1,000 | 0.000 | 0.016 |
| Alloy B | 700 | 2,000 | 0.003 | 0.013 |
| Alloy C | 700 | 2,000 | 0.005 | 0.015 |
| Alloy D | 700 | 2,000 | 0.000 | 0.010 |
| Alloy E | 700 | 1,000 | 0.005 | 0.015 |
| | | 3,988 | 0.005 | 0.018 |
| Alloy F | 700 | 2,000 | 0.001 | 0.012 |
| | | 3,988 | 0.001 | 0.015 |
| Alloy G | 700 | 2,000 | 0.000 | 0.018 |

TABLE V-continued

Flue Gas/Coal Ash Corrosion Data for Selected Alloys Within and Without the Compositional Range of The Present Invention. The Flue Gas Mixture Was 15% $CO_2$B 4% $O_2$B 1.0% $SO_2$Bbal. $N_2$ Flowing at The Rate of 250 Cubic Centimeters per Minute. The Coal Ash Was Composed of 2.5% $Na_2SO_4$ + 2.5% $K_2SO_4$ + 31.67% $Fe_2O_3$ + 31.67% $SiO_2$ + 31.67% $Al_2O_3$ and Applied Using a Water Slurry. The Weight of The Coal Ash Coating Was Approximately 15 mg/cm$^2$. Average uniform metal loss and depth of attack was determined metallographically.

| Alloy | Temperature (° C.) | Time (Hours) | Metal Loss (mm) | Depth of Attack (mm) |
|---|---|---|---|---|
| Alloy H | 700 | 2,000 | 0.000 | 0.016 |
| Alloy 1 | 700 | 1,000 | 0.000 | 0.004 |
| Alloy 1 | 700 | 2,000 | 0.193 | 0.216 |
| Alloy 2 | 700 | 2,000 | 0.020* | 0.027* |
| Alloy 3 | 700 | 2,000 | 0.019 | 0.029 |
| | | | 0.117 | — |

*Sample was uncoated.

TABLE VI

Flue Gas/Coal Ash Corrosion Data for Selected Alloys Outside the Compositional Range of The Present Invention. The Flue Gas Mixture Was 15% $CO_2$B4%$O_2$B1.0%$SO_2$Bbal. $N_2$ Flowing at The Rate of 250 Cubic Centimeters per Minute. The Coal Ash Was Composed of 2.5% $Na_2$ $SO_4$ + 2.5% $K_2SO_4$ + 31.67% $Fe_2O_3$ + 31.67% $SiO_2$+ 31.67% $Al_2O_3$ and Applied Using a Water Slurry. The Weight of The Coal Ash Coating Was Approximately 15 mg/cm$^2$. Average uniform metal loss and depth of attack was determined metallographically.

| Alloy | Temperature (° C.) | Time (Hours) | Metal Loss (mm) | Depth of Attack (mm) |
|---|---|---|---|---|
| Alloy 1 | 700 | 2,000 | 0.193 | 0.2160 |
| Alloy 2 | 700 | 2,000 | 0.067 | 0.0737 |
| Alloy 3 | 700 | 2,000 | 0.062 | 0.0692 |
| Alloy 4 | 700 | 2,000 | 0.052 | 0.0546 |
| Alloy 5 | 700 | 2,000 | 0.020* | 0.027* |
| Alloy 6 | 700 | 2,000 | 0.019 | 0.0290 |
| | | | 0.117 | — |

*Sample was uncoated.

TABLE VII

Samples Immersed in 55% $CaSO_4$ + 30% $BaSO_4$ + 10% $Na_2$ $SO_4$ + 5% C

| Alloy | Metal Loss (mm) | Depth of Oxidation (mm) | Depth of Sulfidation (mm) |
|---|---|---|---|
| Alloy C | 0.0127 | 0.0558 | 0.0622 |
| INCONEL alloy 751 | 0.0546 | 0.1206 | 0.1650 |
| Pyromet alloy 31 | 0.0748 | 0.1662 | 0.1675 |

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A high strength, corrosion resistant alloy which forms a protective layer of α-chromia scale at elevated service temperatures of about 530° C. to 820° C. to improve corrosion resistance in oxidizing and sulfidizing environments, comprising, in % by weight, about: 23.5–25.5%Cr, 15.0–22.0%Co, 0.2–2.0%Al, 0.5–2.5%Ti, 0.5–2.5%Nb, 0.08% C, 0.01–0.3%Zr, 0.001–0.01%B, up to 0.05%rare earth as misch metal, 0.005–0.025%Mg plus Ca, balance Ni plus trace additions and impurities.

2. A high strength Ni—Co—Cr base alloy which forms a protective layer of α-chromia scale at elevated service temperatures of about 530° C. to 820° C. to improve corrosion resistance in oxidizing and sulfidizing environments, particularly sulfur-containing flue gas and diesel engine exhaust, said alloy consisting essentially of, in % by weight: 23.5–25.5%Cr, 15.0–22.0%Co, 0.2–2.0%Al, 0.5–2.5%Ti, 0.5–2.5%Nb, up to 2.0%Mo, up to 1.0%Mn, 0.3–1.0%Si, up to 3.0%Fe, up to 0.3%Ta, up to 0.3%W, 0.005–0.08%C, 0.01–0.3%Zr, 0.001–0.01%B, up to 0.05% rare earth as misch metal, 0.005–0.025%Mg plus optional Ca, balance Ni plus trace additions and impurities.

3. The alloy of claim 2 wherein the Al, Ti and Nb constituents react with Ni to form high temperature hardening phases of γ' and η phases according to a formula:

$$1.7\% \leqq \%Al + 0.56 \times \%Ti + 0.29 \times Nb\% \leqq 3.8\%,$$

and wherein the resulting hardening phases occupy between about 10–20 volume % within a Ni—Co—Cr matrix.

4. An exhaust valve for an diesel engine made from a alloy which forms a protective layer of α-chromia scale at elevated service temperatures of about 530° C. to 820° C. to improve corrosion resistance in oxidizing and sulfidizing environments, said alloy comprising, in % by weight, about: 23.5–25.5%Cr, 15.0–22.0%Co, 0.2–2.0%Al, 0.5–2.5%Ti, 0.5–2.5%Nb, up to 2.0%Mo, up to 1.0%Mn, 0.3–1.0%Si, up to 3.0%Fe, up to 0.3%Ta, up to 0.3%W, 0.005–0.08%C, 0.01–0.3%Zr, 0.001–0.01%B, up to 0.05%rare earth as misch metal, b.005–0.025%Mg plus Ca, balance Ni plus trace additions and impurities.

5. A tube for use in a steam boiler made from a high strength alloy which forms a protective layer of α-chromia scale at elevated service temperatures of about 530° C. to 820° C. to improve corrosion resistance in oxidizing and sulfidizing environments, said alloy comprising, in % by weight, about: 23.5–25.5%Cr, 15.0–22.0%Co, 0.2–2.0%Al, 0.5–2.5%Ti, 0.5–2.5%Nb, up to 2.0%Mo, up to 1.0%Mn, 0.3–1.0%Si, up to 3.0%Fe, up to 0.3%Ta, up to 0.3%W, 0.005–0.08%C, 0.01–0.3%Zr, 0.001–0.01%B, up to 0.05% rare earth as misch metal, 0.005–0.025%Mg plus Ca, balance Ni plus trace additions and impurities.

* * * * *

UNITED STATES PATENT AND TRADEMARK OFFICE

CERTIFICATE OF CORRECTION

PATENT NO. : 6,491,769 B1 
DATED : December 10, 2002
INVENTOR(S) : Gaylord D. Smith et al.

It is certified that error appears in the above-identified patent and that said Letters Patent is hereby corrected as shown below:

Column 10,
Line 5, "A high strength, corrosion resistant" should read -- A corrosion resistant --.
Line 11, "0.5-2.5% Nb, 0.08% C" should read -- 0.5-2.5% Nb, up to 2.0% Mo, up to 1.0% Mn, 0.3-1.0% Si, up to 3.0% Fe, up to 0.3% Ta, up to 0.3% W, 0.005-0.08% C --.
Line 14, "A high strength Ni-Co-Cr base" should read -- A Ni-Co-Cr base --.
Line 35, "an diesel engine made from a alloy" should read -- a diesel engine made from an alloy --.
Line 44, "misch metal, b.005-0.025% Mg" should read -- misch metal, 0.005-0.025% Mg --.
Lines 46 and 47, "a high strength alloy" should read -- an alloy --.

Signed and Sealed this

Twenty-ninth Day of April, 2003

JAMES E. ROGAN
*Director of the United States Patent and Trademark Office*